US005212923A

United States Patent [19]

Pelosi et al.

[11] Patent Number: 5,212,923

[45] Date of Patent: May 25, 1993

[54] PREHUNG GAUGED COVE BASE

[76] Inventors: Lee J. Pelosi; Frank Pelosi, Jr., both of 625 E. Chapel Ave., Cherry Hill, N.J. 08034

[21] Appl. No.: 732,171

[22] Filed: Jul. 18, 1991

[51] Int. Cl.[5] ..... E04F 19/04

[52] U.S. Cl. ..... 52/288; 52/716.1

[58] Field of Search ..... 52/287, 288, 312, 272, 52/273, 312, 716

[56] References Cited

U.S. PATENT DOCUMENTS

| | | | |
|---|---|---|---|
| 3,514,914 | 6/1970 | Bergquist | 52/716 |
| 3,549,471 | 12/1970 | Denton | 52/273 X |
| 5,010,703 | 4/1991 | Pearlman et al. | 52/288 |

FOREIGN PATENT DOCUMENTS

| | | | |
|---|---|---|---|
| 845026 | 8/1960 | United Kingdom | 52/716 |
| 2141457 | 12/1984 | United Kingdom | 52/716 |

*Primary Examiner*—Carl D. Friedman

*Assistant Examiner*—Kien Nguyen

*Attorney, Agent, or Firm*—Laubscher & Laubscher

[57] ABSTRACT

A prehung gauged cove base is adapted to be secured to a wall base and cooperates with the outer edges of a floor covering. The cove base of the invention has an upper portion which resembles an extruded vinyl straight cove base. Extending downwardly from the rear of said upper portion is a thin walled lower gauging portion. The bottom of the gauging portion is adapted to rest on the floor and to raise the lowermost part of the upper portion above the floor a distance substantially equal to the thickness of the floor covering whereby the edges of the floor covering can be tucked under the upper portion of the cove base. The forward end of the lowermost part of the upper portion is preferably pointed downwardly to better flex around and hold the floor covering. The gauging portion may have one or more continuous longitudinal grooves so that portions can be removed by stripping areas away in order to change the height of the gauge.

5 Claims, 2 Drawing Sheets

PREHUNG GAUGED COVE BASE

BACKGROUND OF THE INVENTION

The present invention is directed toward an improved cove base and, more particularly, toward a cove base which is adapted to be secured to a wall base prior to the installation of a floor covering and which cooperates with the outer edges of the floor covering to give the same a finished look when installed.

Cove base or coving which is widely used today is comprised essentially of elongated flat strips of extruded vinyl. Conventional cove bases are normally approximately 1/12 to ⅛ inch thick and have a height of 2½ to 6 inches. They are usually available in lengths of 4 feet or in rolls of substantially longer lengths.

There are generally two types of base cove currently available. The first is referred to as a "straight base" which is essentially a straight piece of vinyl. Straight base coving is normally applied to the wall base prior to the installation of carpeting or other floor covering. As the floor covering is installed, the outer edges thereof must be trimmed substantially perfectly so as to abut evenly against the coving. This can be extremely time consuming and requires the use of skilled labor.

A second type of coving which is currently widely used is referred to as a "top set" cove base. This is similar to the straight base but includes a rounded lip at the bottom thereof which extends forwardly by approximately ⅜ to ½ inch. With top set cove base, the carpeting or other floor covering material is first installed. The coving is then secured to the base of the walls with the rounded lip at the bottom thereof overlying the edges of the floor covering. Non-perfect or uneven edges of the carpeting or other floor covering are, therefore, hidden by the coving.

The top set cove base does not, however, give the same sharp, clean-cut appearance as the straight base and is, therefore, usually less desirable. Furthermore, care must be taken when installing the top set cove base to ensure that the adhesive which must be applied to the back of the coving does not soil or stain the carpeting. This, of course, is not a problem with the straight base coving since the vinyl coving is adhered to the walls before the floor covering is installed. Top set cove base also conforms to minor waves in the floor leaving a less than straight top edge.

SUMMARY OF THE INVENTION

The prehung gauged cove base of the present invention is designed to overcome all of the deficiencies of the prior art described above and to combine the advantages of each of the two types of prior coving now available. In accordance with the invention, the cove base has an upper portion which resembles an extruded vinyl straight cove base. Extending downwardly from the rear of said upper portion is a thin walled lower gauging portion. The bottom of the gauging portion is adapted to rest on the floor and to raise the lowermost part of the upper portion above the floor a distance substantially equal to the thickness of the floor covering whereby the edges of the floor covering can be tucked under the upper portion of the cove base. The forward end of the lowermost part of the upper portion is preferably pointed downwardly to better flex around and hold the floor covering. The gauging portion may have one or more continuous longitudinal grooves so that portions can be removed by stripping areas away in order to change the height of the gauge.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 4:
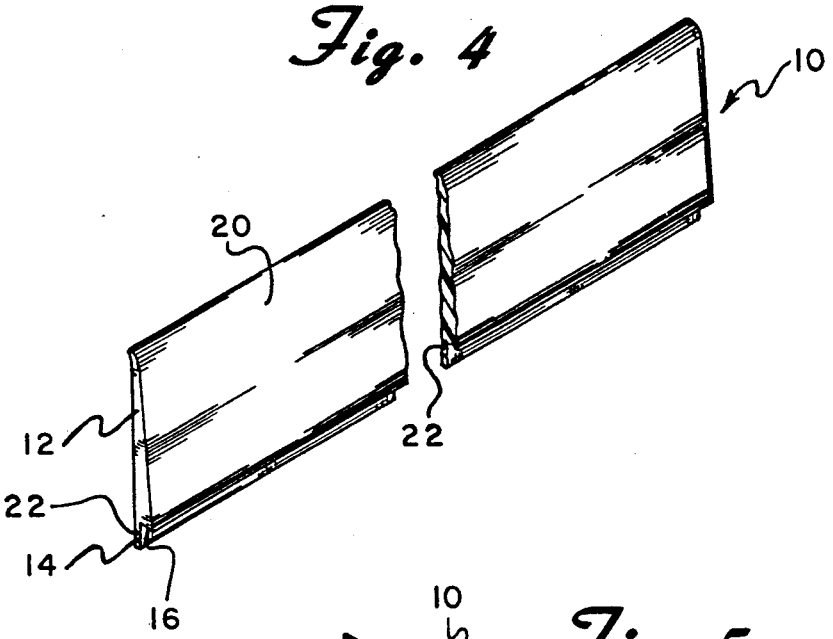
FIG. 4 is a perspective view of a length of prehung gauged cove base in accordance with the invention and showing the front thereof.
Figure 5:
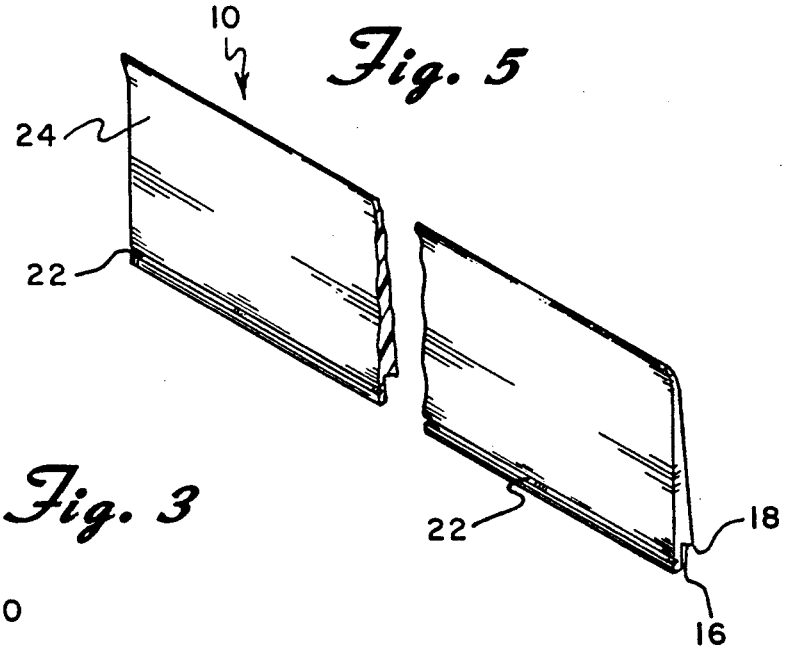
FIG. 5 is a view similar to FIG. 4 but showing the back of the cove base.

Referring now to the drawings in detail wherein like reference numerals have been used throughout the various figures to designate like elements, there is shown in FIGS. 4 and 5 a length of prehung gauged cove base constructed in accordance with the principles of the present invention and designated generally as 10. FIG. 4 shows the front of the cove base while FIG. 5 shows the same from the rear thereof. In each figure, the center portion is broken away to illustrate that the same can be of substantially any length. Thus, the prehung gauged cove base of the present invention could be sold in 4-foot lengths. And since the preferred material from which the cove base is made is extruded vinyl which is somewhat flexible, the cove base could be available in long lengths of material that have been rolled.

Figure 3:
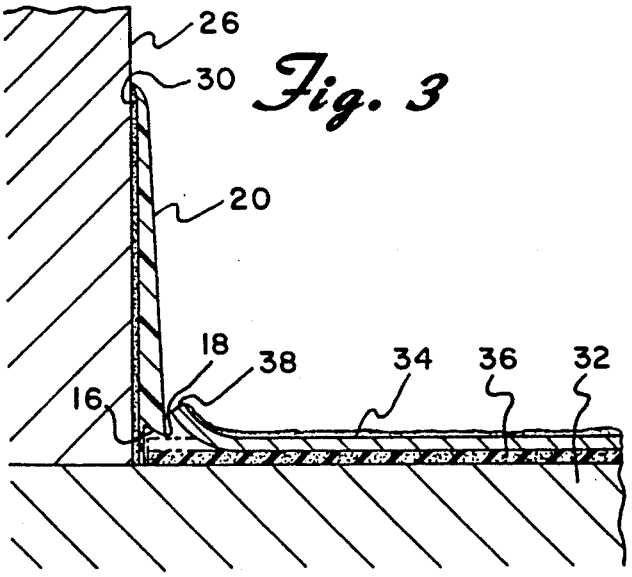
FIG. 3 is a cross-sectional view showing the manner in which the cove cooperates with the floor covering.

The cove base 10 is comprised essentially of an upper portion 12 and a lower gauging portion 14. Located between these two portions is a transition zone which is comprised essentially of a bottom wall 16 at the lower part of the upper section 12. As shown most clearly in FIGS. 3 and 5, the transition wall 16 tapers downwardly and forwardly and terminates in a downwardly extending tip point 18 adjacent the front surface of the upper portion 12.

The upper portion 12 of the cove base 10 very closely resembles a standard straight base type of coving. It may be from 3 to 5 inches high and has a finished front surface 20. The upper portion 12 has a thickness of approximately ⅛ to ¼ inch. In the preferred embodiment, the upper portion tapers slightly from the top to the bottom, as shown, whereby it is somewhat thicker near the lower portion than at the top thereof. The top has a thickness of approximately 1/12 inch which tapers to approximately ¼ inch. As can best be seen from FIG. 3, substantially the entire area of the front surface 20, from adjacent the top thereof to the tip 18, is planar. That is, it lies in a single plane and is not curved at the bottom thereof, thereby more closely resembling a "straight base" cove rather than a curved "top set" cove base.

The lower gauged portion 14 of the cove base 10 is essentially a very thin extension of the back part of the upper portion 12. That is, the lower gauged portion 14 may have a thickness of only approximately 0.05 inch.

The height of the lower gauge portion 14 may vary from ⅛ inch to ½ inch or more for the reasons that will become more apparent below. Furthermore, an area of reduced diameter is formed by having either the front or rear surface of the lower gauge portion 14 be provided with one or more continuous longitudinal grooves such as shown at 22 so that portions may be removed by stripping them away in order to change the height of the lower gauge portion 14.

The rear surface of the prehung gauged cove base 10 is substantially continuous between the upper portion 12 and the lower portion 14. As is known in the art, this rear surface 24 is unfinished and preferably has a rough finish or a plurality of grooves (not shown) so that adhesive used to secure the coving 10 to a wall base will adhere more tightly thereto.

Figure 1:
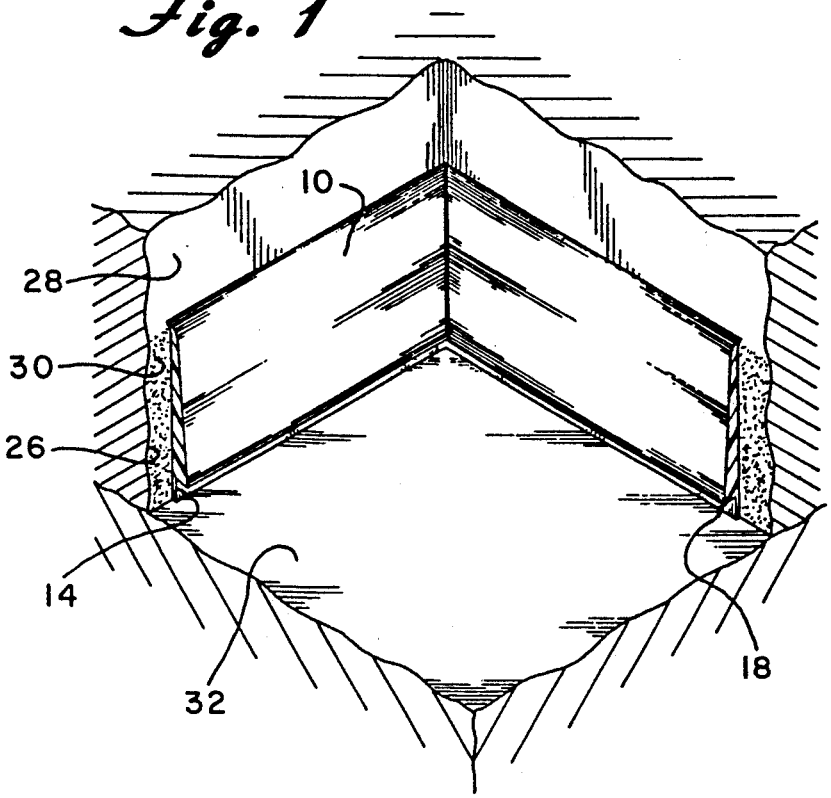
FIG. 1 is a perspective view of prehung gauged coving in accordance with the present invention and applied to the base of a wall at a corner thereof before the floor covering is installed.
Figure 2:
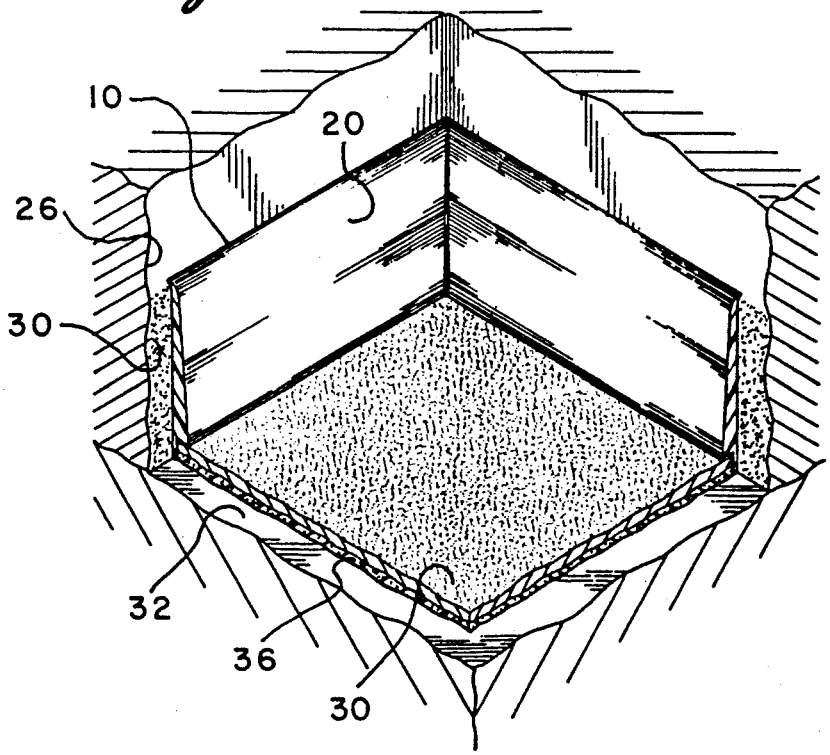
FIG. 2 is a view similar to FIG. 1 but showing the same with the floor covering installed.

The prehung gauged cove base 10 described above is utilized in the following manner. First, cove base 10 having a lower gauging portion of the proper height is selected. This height is chosen to be substantially equal to the thickness of the floor covering which will be used. As shown in FIG. 1, the cove base 10 is secured to the base 26 of a wall 28 through the use of adhesive 30 before any floor covering is placed on the floor 32. When the cove base 10 is being installed, the lowermost portion of the gauge 14 rests on the floor 32. It should be readily apparent that since the lower gauging portion 14 is so thin any imperfections in the flooring merely cause the gauging portion to flex or deform slightly so that the cove base remains substantially horizontally aligned. FIG. 1 shows two portions of cove base 10 meeting in a corner. It should be readily apparent to those skilled in the art that these corners can be easily mitered.

Once the cove base 10 has been installed around the perimeter of the room, the floor covering such as carpeting 34 can then be installed on the floor 32. In most modern industrial or commercial applications, this is done by adhering the carpeting or carpet and pad directly to the floor through the use of an adhesive 36. When the floor covering is being installed, the outer edges such as edge 38 (FIG. 3) are trimmed so as to be just short of the wall. However, as can be seen, this cut need not be extremely accurate. After the main portion of the floor covering is installed, the outer edges are then pushed down and using a straight edge tool are inserted under the bottom wall 16 of the upper portion 12. This is easily done since the carpet edge and vinyl tip 18 of the upper portion 12 can be relatively easily flexed. Once the carpet edge 38 is in position, it tends to be held there by the point 18 at the lower forward end of the upper portion 12.

The prehung gauged cove base 10 of the present invention is preferably made from a vinyl plastic material. This allows the same to be extruded in indefinite lengths. It should be readily apparent, however, that the cove base 10 can be made of other materials and by other methods. Furthermore, the exact shape and appearance of the cove base 10 can vary.

The present invention may be embodied in other specific forms without departing from the spirit or essential attributes thereof and accordingly reference should be made to the appended claims rather than to the foregoing specification as indicating the scope of the invention.

We claim:

1. A cove base adapted to be secured to a wall base and to cooperate with the outer edges of a floor covering to give the same a finished look when installed, comprising an elongated substantially flat member having a height dimension of at least two and one-half inches which is substantially greater than the thickness thereof, said member having an upper portion and a lower gauging portion, the rear surface of said upper and lower portions being substantially continuous and being adapted to be affixed to said wall base, said upper portion having a finished front surface, substantially the entire area of said front surface being planar and lying in a single plane, said lower gauging portion having a height and thickness which are substantially less than the height and thickness of said upper portion, a transition zone including a bottom wall on said upper portion which tapers downwardly and forwardly toward said front planar surface, said bottom wall intersecting said front planar surface and forming a tip which points substantially downwardly.

2. The invention as claimed in claim 1 wherein said upper portion has a top and a bottom and is thinner adjacent the top thereof than adjacent the bottom.

3. The invention as claimed in claim 2 wherein the thickness of said upper portion tapers gradually and substantially continuously from the top to the bottom.

4. The invention as claimed in claim 1 wherein said lower gauging portion includes an area of reduced diameter extending the length thereof.

5. The invention as claimed in claim 4 wherein said area of reduced diameter is located intermediate said upper portion and the lowermost edge of said lower portion.

* * * * *

UNITED STATES PATENT AND TRADEMARK OFFICE

CERTIFICATE OF CORRECTION

PATENT NO. : 5,212,923

DATED : May 25, 1993

INVENTOR(S) : Lee J. Pelosi, Frank Pelosi, Jr.

It is certified that error appears in the above-identified patent and that said Letters Patent is hereby corrected as shown below:

Column 2, line 2,

On the title page, the name following Attorney, Agent, or Firm should read Norman E. Lehrer.

Column 4, line 32, after "zone" insert --located between said upper and lower portions, said transition zone--.

Signed and Sealed this

First Day of February, 1994

Bruce Lehman

*Attest:*

BRUCE LEHMAN

*Attesting Officer*

*Commissioner of Patents and Trademarks*